US009658640B2

(12) United States Patent
Lee

(10) Patent No.: US 9,658,640 B2
(45) Date of Patent: May 23, 2017

(54) ELECTRONIC DEVICE CONTROL BUTTON OF VEHICLE

(71) Applicant: HYUNDAI MOTOR COMPANY, Seoul (KR)

(72) Inventor: Young Jin Lee, Seoul (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 121 days.

(21) Appl. No.: 14/740,225

(22) Filed: Jun. 15, 2015

(65) Prior Publication Data

US 2015/0364279 A1 Dec. 17, 2015

(30) Foreign Application Priority Data

Jun. 13, 2014 (KR) ..... 10-2014-0072421

(51) Int. Cl.

| | |
|---|---|
| ***G05G 9/02*** | (2006.01) |
| ***G05G 9/04*** | (2006.01) |
| *G05G 1/02* | (2006.01) |
| *H01H 25/00* | (2006.01) |

(52) U.S. Cl.

CPC ..... *G05G 9/02* (2013.01); *G05G 9/04* (2013.01); *G05G 1/025* (2013.01); *H01H 25/006* (2013.01); *Y10T 74/20012* (2015.01)

(58) Field of Classification Search

CPC ..... H01H 19/20; G05G 9/02; B60R 16/023
USPC ..... 200/52 R
See application file for complete search history.

(56) References Cited

U.S. PATENT DOCUMENTS

| | | | | |
|---|---|---|---|---|
| 8,130,214 | B2 * | 3/2012 | Aimi | G06F 3/0362 200/336 |
| 2007/0062790 | A1 * | 3/2007 | Lee | H01H 21/24 200/37 R |
| 2013/0199901 | A1 * | 8/2013 | Kreider | B60K 37/06 200/4 |

FOREIGN PATENT DOCUMENTS

| | | | |
|---|---|---|---|
| JP | 2014-109840 | A | 6/2014 |
| KR | 10-0165086 | B1 | 2/1999 |
| KR | 10-0960233 | B1 | 6/2010 |

* cited by examiner

*Primary Examiner* — Edwin A. Leon
*Assistant Examiner* — Iman Malakooti
(74) *Attorney, Agent, or Firm* — McDermott Will & Emery LLP

(57) ABSTRACT

An electronic device control button of a vehicle includes: i) a jog-shuttle configured to control an electronic device including a navigation device for the vehicle; ii) a base part configured to rotatably support the jog-shuttle and slidably move in upward and downward directions from a reference position on a center fascia panel; iii) a return spring provided on the center fascia panel, configured to limit movement of the jog-shuttle, and to recover the jog-shuttle to the reference position; and iv) a terminal part provided at the jog-shuttle and configured to make contact with or be separated from a slot of a circuit board to apply and block different electrical signals to and from the electronic device.

10 Claims, 5 Drawing Sheets

ELECTRONIC DEVICE CONTROL BUTTON OF VEHICLE

CROSS-REFERENCE TO RELATED APPLICATION

This application claims priority to and the benefit of Korean Patent Application No. 10-2014-0072421 filed in the Korean Intellectual Property Office on Jun. 13, 2014, the entire contents of which are incorporated herein by reference.

TECHNICAL FIELD

The present disclosure relates to an electronic device control button of a vehicle, and more particularly, to an electronic device control button of a vehicle which allows a driver to rapidly and conveniently operate an electronic device mounted in the vehicle during driving of the vehicle.

BACKGROUND

In general, various electronic devices such as a navigation device, a sound device, and a black box device are mounted in a vehicle.

Accordingly, a driver selects and controls desired devices during driving the vehicle, respectively. In this case, the driver operates the electronic devices in the vehicle by using a jog-shuttle provided on a center fascia panel.

For example, the jog-shuttle is a control button used to play a sound, adjust a volume of the sound, and change a radio frequency in a rotation and push scheme.

Meanwhile, the navigation device mounted inside the vehicle to guide a running direction of the vehicle requires an operation with respect to extension and reduction of a map. Since the navigation device is operated by directly touching a screen of the navigation device, the driver has to operate the navigation device while watching the screen of the navigation device. Accordingly, it is inconvenient and unsafe for the driver to operate the navigation device while driving the vehicle, as eyes of the driver are deviated from the road to cause vehicle accidents.

The above information disclosed in this Background section is only for enhancement of understanding of the background of the invention and therefore it may contain information that does not form the prior art that is already known in this country to a person of ordinary skill in the art.

SUMMARY

The present invention has been made in an effort to provide an electronic device control button of a vehicle having advantages of extending and reducing a display such as a map of a navigation device by simple control of a jog-shuttle while maintaining a sound control function of an electronic device through the jog-shuttle.

An exemplary embodiment of the present invention provides an electronic device control button of a vehicle, including: i) a jog-shuttle configured to control an electronic device including a navigation device for the vehicle; ii) a base part configured to rotatably support the jog-shuttle and slidably move in upward and downward directions from a reference position on a center fascia panel; iii) a return spring provided on the center fascia panel, configured to limit movement of the jog-shuttle, and to recover the jog-shuttle to the reference position; and iv) a terminal part provided at the jog-shuttle and configured to make contact with or be separated from a slot of a circuit board to apply and block different electrical signals to and from the electronic device.

In the electronic device control button of a vehicle in accordance with an exemplary embodiment of the present invention, a clearance space may be formed on the base part and the center fascia panel so that the base part is slidably moved in upward and downward directions.

In the electronic device control button of a vehicle in accordance with an exemplary embodiment of the present invention, a sliding part may be further formed between the base part and the center fascia panel and configured to slidably move the jog-shuttle in the upward and downward directions.

In the electronic device control button of a vehicle in accordance with an exemplary embodiment of the present invention, the sliding part may include: a pair of sliders provided on the center fascia panel; and a pair of guide pins provided on the base part to be inserted into the sliders, respectively.

In the electronic device control button of a vehicle in accordance with an exemplary embodiment of the present invention, the slider may be formed therein with a guide groove to guide movement of the guide pin.

In the electronic device control button of a vehicle in accordance with an exemplary embodiment of the present invention, the return spring may be bent toward the base part and a bent portion of the return spring makes contact with the jog-shuttle.

In the electronic device control button of a vehicle in accordance with an exemplary embodiment of the present invention, the terminal part may include: a first terminal part making contact with a first slot of the circuit board for supplying power; a second terminal part making contact with or being separated from a second slot of the circuit board to which an electrical signal for controlling volume of the electronic device is applied when the jog-shuttle is slidably moved in the upward and downward directions; and a third terminal part making contact with or being separated from a third slot of the circuit board to which an electrical signal for controlling a display size of the electronic device is applied when the jog-shuttle is slidably moved in the upward and downward directions.

In the electronic device control button of a vehicle in accordance with an exemplary embodiment of the present invention, the first terminal part may make contact with the first slot of the circuit board when the jog-shuttle is located at the reference position, and the first terminal part may make contact with the first slot of the circuit board when the jog-shuttle is slidably moved upward from the reference position.

In the electronic device control button of a vehicle in accordance with an exemplary embodiment of the present invention, the second terminal part may make contact with the second slot of the circuit board when the jog-shuttle is located at the reference position, and the second terminal part may be separated from the second slot of the circuit board when the jog-shuttle is slidably moved upward from the reference position.

In the electronic device control button of a vehicle in accordance with an exemplary embodiment of the present invention, the third terminal part may make contact with the third slot of the circuit board when the jog-shuttle is slidably moved upward from the reference position, and the third terminal part may be separated from the third slot of the PCB when the jog-shuttle is slidably moved to the reference position from the upward direction.

Another exemplary embodiment of the present invention provides an electronic device control button of a vehicle including a jog-shuttle formed on a center fascia panel, including first and second terminal parts, and configured to control an electronic device of the vehicle; a base part configured to rotatably support the jog-shuttle, and to slidably move, together with the jog-shuttle, in upward and downward directions along the center fascia panel from a first position to a second position; a return spring coupled to the center fascia panel, and configured to limit movement of the jog-shuttle and to recover the jog-shuttle from the second position to the first position; and a circuit board having first and second electric traces. The circuit board may provide a first control signal to the electronic device upon the first electric trace and the first terminal part contacting each other at the first position, and provide a second control signal to the electronic device upon the second electric trace and the second terminal part contacting each other at the second position.

The exemplary embodiment of the present invention allows a driver to conveniently and rapidly operate other functions of the electronic device by moving the jog-shuttle while playing a sound and adjusting a volume of the sound by rotating and pushing the jog-shuttle.

Further, since the driver may rapidly and safely operate a map reduction and extension function of the electronic device such as the navigation device by vertically moving the jog-shuttle, the convenience of the driver may be improved.

BRIEF DESCRIPTION OF THE DRAWINGS

In the following detailed description, only certain exemplary embodiments of the present invention have been shown and described, simply by way of illustration.

DETAILED DESCRIPTION

Figure 1:
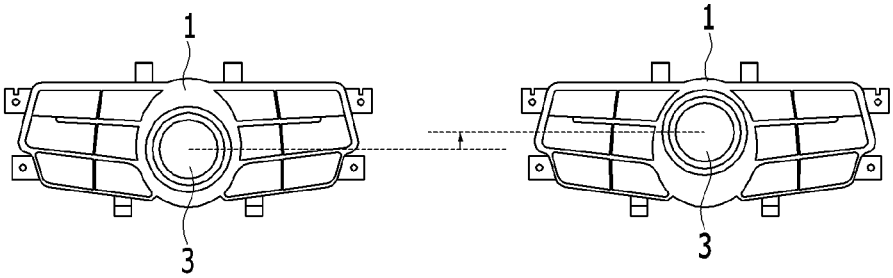
FIG. 1 is a front view illustrating a movement of an electronic device control button of a vehicle in accordance with an exemplary embodiment of the present invention.

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention.

Parts that are irrelevant to the description are omitted to clearly illustrate the present invention, and like reference numbers designate like constituent elements through the specification.

Further, the size and thickness of each configuration shown in the drawings are arbitrarily illustrated for better understanding and ease of description, the present invention is not limited to shown drawings, and the thicknesses are exaggerated for clarity of a plurality of parts and regions.

In a following detailed description, the terms "first" and "second" will be used to discriminate one component from another component, but the components may not be limited to the above terms.

In addition, in the following description, unless explicitly described to the contrary, the word "comprise" and variations such as "comprises" or "comprising" will be understood to imply the inclusion of stated elements but not the exclusion of any other elements.

In the following description, "~unit", "~means", "~part", and "~member" mean a unit of a general configuration to perform at least one function or operation.

Figure 2:
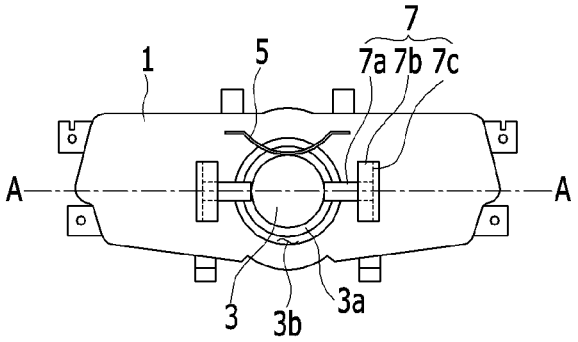
FIG. 2 is a rear view illustrating a center fascia panel of an electronic device control button in accordance with an exemplary embodiment of the present invention.
Figure 3:
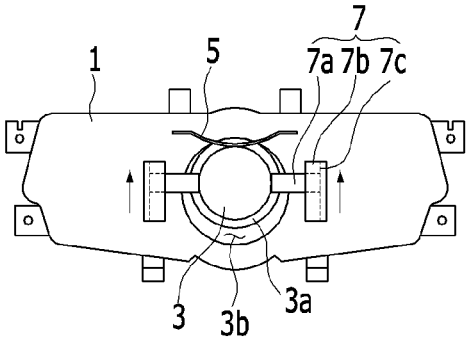
FIG. 3 is a rear view illustrating a moved state of the electronic device control button on the center fascia panel in accordance with an exemplary embodiment of the present invention.

FIG. 1 is a front view illustrating a movement of an electronic device control button of a vehicle in accordance with an exemplary embodiment of the present invention, FIG. 2 is a rear view illustrating a center fascia panel of an electronic device control button in accordance with an exemplary embodiment of the present invention, and FIG. 3 is a rear view illustrating a moved state of the electronic device control button on the center fascia panel in accordance with an exemplary embodiment of the present invention.

Referring to FIGS. 1 to 3, the electronic device control button in accordance with an exemplary embodiment of the present invention is applicable to a control device of an electronic device mounted inside the vehicle, for example, a sound device and a navigation device.

Referring to FIGS. 1 to 3, the electronic device control button in accordance with an exemplary embodiment of the present invention includes a jog-shuttle 3, a base part 3*a*, a return spring 5, and a sliding part 7.

The jog-shuttle 3 is a control button to control various electronic devices including a navigation device (not shown) for the vehicle in a rotation and push scheme.

For example, the jog-shuttle 3 is provided on a center fascia panel 1 and may control the electronic devices in a rotation and push scheme.

Further, the base part 3*a* supports the jog-shuttle 3, and may be slidably moved on the center fascia panel 1 in upward and downward directions, that is, may be slidably installed in a reference position.

In addition, a clearance space 3*b* is formed on the base part 3*a* and the center fascia panel 1 so that the base part 3*a* may be slidably moved in the vertical direction.

In this case, the reference position signifies a home position state of the jog-shuttle 3 which may adjust a volume of the electronic device through the jog-shuttle 3 when a map function of a navigation device (not shown) maintains initialization.

Moreover, the return spring 5 is installed at the center fascia panel 1, and limits an upward movement of the jog-shuttle 3 and recovers the jog-shuttle 3 to the reference position.

In this case, the return spring 5 is bent toward the base part 3*a* and a bent portion of the return spring 5 makes contact with the jog-shuttle 3.

For example, the return spring 5 may include a plate spring having a plate shape which is bent toward to the base part 3*a*.

That is, when the jog-shuttle 3 is slid upward by an external force, the return spring 5 is compressed in the upward direction by the jog-shuttle 3 to limit the upward movement of the jog-shuttle 3.

In addition, if the external force is removed from the jog-shuttle 3, the return spring 5 moves the jog-shuttle 3 in the downward direction to the reference position due to an elastic restoring force.

Figure 4:
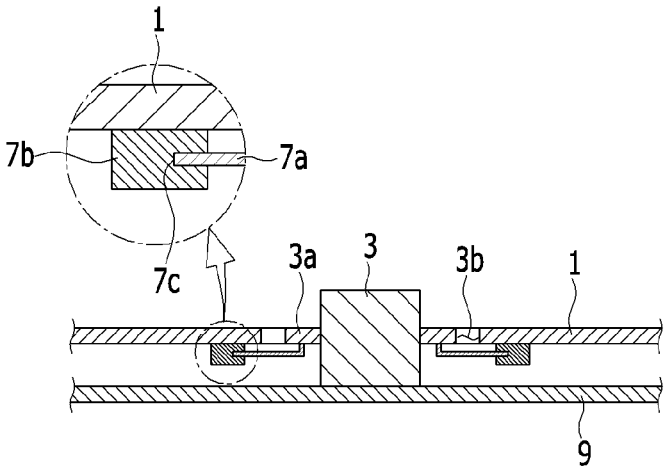
FIG. 4 is a cross-sectional view of the center fascia panel of an electronic device control button taken along line A-A of FIG. 2 in accordance with an exemplary embodiment of the present invention.

FIG. 4 is a cross-sectional view taken along line A-A of the center fascia panel of an electronic device control button in accordance with an exemplary embodiment of the present invention.

Referring to FIG. 3 and FIG. 4, the sliding part 7 in accordance with an exemplary embodiment of the present invention is provided between the base part 3*a* and the center fascia panel 1 and slidably moves the jog-shuttle 3 in upward and downward directions.

The sliding part 7 includes sliders 7*a* and guide pins 7*b*.

The sliders 7*a* are provided at both sides of the center fascia panel 1 corresponding to right and left sides of the base part 3*a*, respectively.

In addition, the guide pins 7*b* are provided at both sides of the base part 3*a*, respectively, and are slidably coupled with the sliders 7*a*, respectively.

Furthermore, the slider 7*a* is formed therein with a guide groove 7*c* for guiding the relative movement of the guide pin 7*b*.

Figure 5:
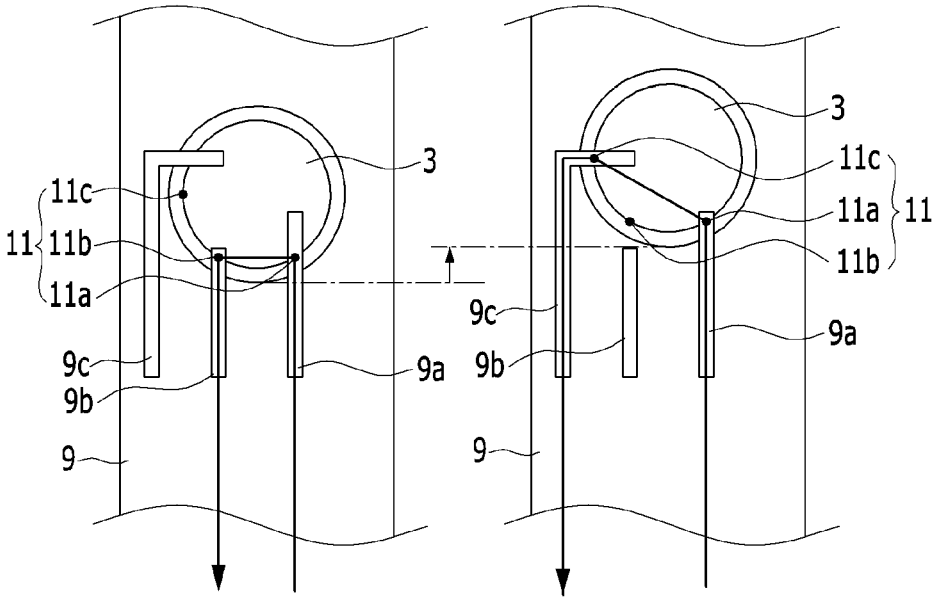
FIG. 5 is a schematic view illustrating a contact state and a separated state of a contact point on a PCB by moving the electronic device control button of the vehicle in accordance with an exemplary embodiment of the present invention.

FIG. 5 is a schematic view illustrating a contact state and a separated state of a contact point on a printed circuit board (PCB) by moving the electronic device control button of the vehicle in accordance with an exemplary embodiment of the present invention.

Referring to FIG. 5, a terminal part 11 in accordance with an exemplary embodiment of the present invention is provided at the jog-shuttle 3, and makes contact with or is separated from a slot of a PCB 9 to apply and block different electrical signals to and from the electronic device.

In this case, the PCB 9 is a signal processor which processes an electrical signal for controlling the overall operation of the electronic device, volume, and display.

The terminal part 11 includes a first terminal part 11*a*, a second terminal part 11*b*, and a third terminal part 11*c*.

When the jog-shuttle 3 is located at the reference position, the first terminal part 11*a* makes contact with a first slot 9*a* of the PCB 9 for supplying power. Alternatively, when the jog-shuttle 3 is slidably moved upward from the reference position, the first terminal part 11*a* makes contact with the first slot 9*a* of the PCB 9.

In contrast, when the jog-shuttle 3 is slidably moved in upward and downward directions, the second terminal part 11*b* makes contact with and is separated from a second slot 9*b* of the PCB 9 to which an electrical signal for adjusting a volume of the electronic device of the vehicle is applied.

When the jog-shuttle 3 is located at the reference position, the second terminal part 11*b* makes contact with the second slot 9*b*. When the jog-shuttle 3 is slidably moved in the upward direction from the reference position, the second terminal part 11*b* is separated from the second slot 9*b*.

Further, when the jog-shuttle 3 is slidably moved in upward and downward directions, the third terminal part 11*c* makes contact with or is separated from a third slot 9*c* of the PCB 9 to which an electrical signal for controlling extension and reduction of a display size of the electronic device, that is, a map of a navigation device.

When the jog-shuttle 3 is slidably moved in the upward direction from the reference position, the third terminal part 11*c* makes contact with the third slot 9*c*. When the jog-shuttle 3 is moved to the reference position from the upward direction, the third terminal part 11*c* is separated from the third slot 9*c*.

Hereinafter, a control state of the electronic device control button of the vehicle in accordance with an exemplary embodiment of the present invention will be described in detail with reference to FIG. 3 and FIG. 5.

First, at normal times, the jog-shuttle 3 is located in the reference position, and the second terminal part 11*b* makes contact with the second slot 9*b* of the PCB 9.

In this case, the driver may control the volume of the electronic device by rotating the jog-shuttle 3 without moving the jog-shuttle 3 from the reference position while driving the vehicle.

Meanwhile, when there is a need to control the display size of the electronic device, for example, when the driver needs to reduce and extend the navigation map (not shown) while driving the vehicle, the driver slidably moves the jog-shuttle 3 located at the reference position in the upward direction of the center fascia panel 1.

In this case, the base part 3*a* is slidably moved in the upward direction through the clearance space 3*b* formed on the base part 3*a* and the center fascia panel 1.

Further, when the base part 3*a* is moved, the guide pin 7*b* is moved from the slider 7*a* and the jog-shuttle 3 is slidably moved in the upward direction from the reference position.

In this case, if the jog-shuttle 3 is slidably moved, the return spring 5 is compressed in the upward direction to limit the upward movement of the jog-shuttle 3.

As described above, when the jog-shuttle 3 is slidably moved in the upward direction, the third terminal part 11*c* makes contact with the third slot 9*c* of the PCB 9.

When the electrical signal for controlling the display size of the electronic device is applied to the third terminal, the driver may control the display size of the electronic device by rotating the jog-shuttle 3.

In this case, an electrical signal for controlling a size of a map of a navigation device (not shown) mounted in the vehicle is applied to a display of the electronic device so that the size of the map in the navigation device may be adjusted.

Further, if the driver removes the force from the jog-shuttle 3, the control of the display size in the electronic device is terminated.

Accordingly, the jog-shuttle 3 is moved to the reference position from the upward direction due to the elastic restoring force of the return spring 5 and a contact point of the third terminal part 11*c* is separated from the third slot 9*c*.

Next, when the jog-shuttle 3 is moved to the reference position, the second slot 9*b* of the PCB 9 makes contact with the second terminal part 11*b*.

In this way, if the jog-shuttle 3 is moved to the reference position, the driver may control the volume of the electronic device by merely rotating the jog-shuttle 3 without slidably moving the jog-shuttle 3.

In this case, the volume of the navigation device and the volume of the sound device may be controlled by applying an electrical signal for controlling the volume of the navigation device (not shown) mounted inside the vehicle and an electrical signal for controlling the volume of the sound device as the electrical signal for controlling the volume of the electronic device.

As is seen from the forgoing description, the electronic device control button of the vehicle in accordance with an exemplary embodiment of the present invention allows the driver to conveniently and rapidly control other functions in addition to playback and volume adjustment of the electronic device by slidably moving the jog-shuttle 3.

Further, since the driver may rapidly and safely control a map reduction and extension function of the electronic device such as the navigation device by vertically moving the jog-shuttle, convenience of the driver may be improved.

An exemplary embodiment of the present invention is disclosed herein, but the present invention is not limited to the disclosed embodiments, and, on the contrary, is intended to cover various modifications and equivalent arrangements included within the appended claims and the detailed description and the accompanying drawing of the present invention.

What is claimed is:

1. An electronic device control button of a vehicle, comprising:

a jog-shuttle configured to control an electronic device including a navigation device for the vehicle;

a base part configured to rotatably support the jog-shuttle and slidably move in upward and downward directions from a reference position on a center fascia panel;

a return spring provided on the center fascia panel, and configured to limit movement of the jog-shuttle and to recover the jog-shuttle to the reference position; and a terminal part provided at the jog-shuttle and configured to make contact with or be separated from a slot of a circuit board to apply and block different electrical signals to and from the electronic device, wherein the terminal part comprises:

a first terminal part making contact with a first slot of the circuit board for supplying power;

a second terminal part making contact with or being separated from a second slot of the circuit board to which an electrical signal for controlling volume of the electronic device is applied when the jog-shuttle is slidably moved in the upward and downward directions; and a third terminal part making contact with or being separated from a third slot of the circuit board to which an electrical signal for controlling a display size of the electronic device is applied when the jog-shuttle is slidably moved in the upward and downward directions.

2. The electronic device control button of a vehicle of claim 1, wherein a clearance space is formed on the base part and the center fascia panel so that the base part is slidably moved in the upward and downward directions.

3. The electronic device control button of claim 1, wherein a sliding part is further formed between the base part and the center fascia panel and configured to slidably move the jog-shuttle in the upward and downward directions.

4. The electronic device control button of claim 3, wherein the sliding part comprises:

a pair of sliders provided on the center fascia panel; and a pair of guide pins provided on the base part to be inserted into the sliders, respectively.

5. The electronic device control button of claim 4, wherein the slider is formed therein with a guide groove to guide relative movement of the guide pin.

6. The electronic device control button of claim 1, wherein the return spring is bent toward the base part and a bent portion of the return spring makes contact with the jog-shuttle.

7. The electronic device control button of claim 1, wherein the first terminal part makes contact with the first slot of the PCB when the jog-shuttle is located at the reference position, and the first terminal part makes contact with the first slot of the PCB when the jog-shuttle is slidably moved upward from the reference position.

8. The electronic device control button of claim 7, wherein the second terminal part makes contact with the second slot of the circuit board when the jog-shuttle is located at the reference position, and the second terminal part is separated from the second slot of the circuit board when the jog-shuttle is slidably moved upward from the reference position.

9. The electronic device control button of claim 8, wherein the third terminal part makes contact with the third slot of the circuit board when the jog-shuttle is slidably moved upward from the reference position, and the third terminal part is separated from the third slot of the circuit board when the jog-shuttle is slidably moved to the reference position from the upward direction.

10. An electronic device control button of a vehicle, comprising:

a jog-shuttle formed on a center fascia panel, including first and second terminal parts, and configured to control an electronic device of the vehicle;

a base part configured to rotatably support the jog-shuttle, and to slidably move, together with the jog-shuttle, in upward and downward directions along the center fascia panel from a first position to a second position;

a return spring coupled to the center fascia panel, and configured to limit movement of the jog-shuttle and to recover the jog-shuttle from the second position to the first position; and a circuit board having first and second electric traces, wherein the circuit board provides a first control signal to the electronic device upon the first electric trace and the first terminal part contacting each other at the first position, and provides a second control signal to the electronic device upon the second electric trace and the second terminal part contacting each other at the second position, and wherein the first terminal part makes contact with a first slot of the circuit board for supplying power, the second terminal part makes contact with or being separated from a second slot of the circuit board to which an electrical signal for controlling volume of the electronic device is applied when the jog-shuttle is slidably moved in the upward and downward directions, and a third terminal part makes contact with or is separated from a third slot of the circuit board to which an electrical signal for controlling a display size of the electronic device is applied when the jog-shuttle is slidably moved in the upward and downward directions.

* * * * *